US005465472A

United States Patent [19]

Matoba

[11] Patent Number: 5,465,472

[45] Date of Patent: Nov. 14, 1995

[54] BUCKLE

[75] Inventor: Hiroshi Matoba, Toyama, Japan

[73] Assignee: YKK Corporation, Tokyo, Japan

[21] Appl. No.: 315,357

[22] Filed: Sep. 30, 1994

[30] Foreign Application Priority Data

Oct. 16, 1993 [JP] Japan ..... 5-060576
Apr. 20, 1994 [JP] Japan ..... 6-105945

[51] Int. Cl.[6] ..... A44B 11/00

[52] U.S. Cl. ..... 24/625; 24/616; 24/664

[58] Field of Search ..... 24/625, 614, 615, 24/616, 647, 632, 630, 633, 629, 664, 597

[56] References Cited

U.S. PATENT DOCUMENTS 1,477,597 12/1923 Schneider ..... 24/616
4,672,725 6/1987 Kasai ..... 24/625
5,237,728 8/1993 Fudaki ..... 24/616
5,291,641 3/1994 Morino ..... 24/625

FOREIGN PATENT DOCUMENTS 0204250 12/1986 European Pat. Off. .
0467574 1/1992 European Pat. Off. .
2150632 7/1985 United Kingdom .
2262962 7/1993 United Kingdom .

*Primary Examiner*—Victor N. Sakran
*Attorney, Agent, or Firm*—Hill, Steadman & Simpson

[57] ABSTRACT

A plug member of a buckle has a pair of engaging legs receivable in a socket member to couple the plug member and the socket member. The engaging legs are curved inwardly toward each other and each of which has an elongated opening extending longitudinally thereof and extending across its thickness. The socket member includes an upper plate and a lower plate defining therebetween a guide chamber and interconnected by a central guide wall. The socket member includes a pair of retaining portions disposed in the guide chamber for interlocking engagement with a pair of locking portions formed at the leading ends of the respective engaging legs. Each of the engaging legs each has a recessed thin guide portion which is smaller in thickness than an operating portion of each engaging leg. The buckle thus constructed is relatively small in thickness, can be coupled and uncoupled reliably and smoothly with a relatively small force, and is able to withstand undue force or pressure tending to damage the buckle.

5 Claims, 10 Drawing Sheets

BUCKLE

BACKGROUND OF THE INVENTION

1. Field of the Invention

The present invention relates to a buckle used as a fastening device for releasably joining loose ends of belts or straps secured to various articles such as garments, bags and helmets.

2. Description of the Prior Art

One known buckle attached, for example, to opposite ends of a belt or strap is disclosed in British Patent No. 2262962. The disclosed buckle is composed of a male or plug member and a female or socket member releasably engageable with each other. The plug member includes a base and a pair of engaging legs projecting linearly from the base and having at their leading ends a pair of locking portions, respectively. The socket member has a pair of retaining portions for interlocking engagement with the locking portions of the plug member. Each of the engaging legs has an operating portion in the form of a bulged outer side flange adapted to be operated to release the locking engagement between the locking portions and the retaining portions within the socket member. The socket member has two confronting slots from which the operating portions of the engaging legs are exposed when the locking portions of the engaging legs inserted through an end opening of the socket member in the socket member are locked with the retaining portions of the socket member.

To couple the buckle, the engaging legs of the plug member are inserted into the socket member through the end opening of the latter until the locking portions of the engaging legs are locked with the retaining portions in the socket member. During that time, on progressive insertion in the socket member, the engaging legs are resiliently deflected inwardly toward each other as outer peripheral surfaces of the locking portions slidably contact with the retaining portions in the socket member. When the engaging legs are forced into the socket member until the locking portions move past the retaining portions, the inwardly deflected engaging legs are allowed to spring back to their normal undeflected position where the locking portions are locked with the retaining portions.

The prior art buckle has a drawback that the engaging legs and the operating portions which are both inserted into the socket member to interlock the locking portions and the retaining portions enlarge the size and particularly the thickness of the socket member and increase the degree of deflection of the engaging arms. In addition, since the engaging legs are formed straight and relatively rigid against lateral deflection, they are able to insure a firm engagement between the locking portion and the retaining portion with an increased coupling strength but require a relatively large force to greatly deflect the engaging legs and thus hinder smooth insertion of the plug member in the socket member. To uncouple the buckle, the operating portions must be depressed with a great force or pressure to greatly deflect the engaging legs to disengage the locking portions and the retaining portions with the result that smooth uncoupling operation is difficult to achieve. Furthermore, the engaging legs which are relatively rigid and hence inflexible, as described above, are likely to be damaged when subjected to undue pressure or force. If the rigidity of the engaging legs is lowered to facilitate the coupling and uncoupling operation of the buckle, the coupling strength between the plug member and the socket member would be reduced. Thus, the conventional buckle undergoes a mutual conflict in terms of the easiness of manipulation and the coupling strength.

SUMMARY OF THE INVENTION

With the foregoing drawbacks of the prior art in view, it is an object of the present invention to provide a buckle which is relatively small in thickness, can be coupled and uncoupled reliably and smoothly, and is able to withstand undue force or pressure tending to damage the buckle.

According to the present invention, there is provided a buckle, which comprises a plug member and a socket member which are releasably engageable with each other, the plug member including a base and a pair of resiliently deflectable engaging legs projecting from the base and receivable in the socket member, the engaging legs each having a locking portion at a leading end thereof, the socket member having a guide chamber for receptive engagement with the engaging legs, an end opening communicating with the guide chamber, and a pair of retaining portions disposed in the guide chamber for locking engagement with the locking portions of the engaging legs, respectively, the engaging-legs being curved inwardly toward each other and each having an elongated opening extending longitudinally of the engaging leg and extending through the thickness of the engaging leg. The socket member has an upper plate and a lower plate, and a central guide wall interconnecting the upper and lower plates along their central portions extending parallel to the direction of insertion of the plug member so as to define the guide chamber between the upper and lower plates.

According to a preferred embodiment, the locking portion is disposed on each of an upper surface and a lower surface of each of the engaging legs. The pair of retaining portions is disposed on each of the upper plate and the lower plate. And, each of the locking portions has an abutment portion which is engageable with an inner side surface of a corresponding one of the retaining portions when the locking portion and the retaining portion are lockingly engaged with each other.

According to another preferred embodiment, the socket member has a pair of slots formed in confronting relation in opposite sides of the socket member and extending in the direction of insertion of the plug member from the end opening, and a pair of slit extending continuously from the slots, respectively, in the direction of insertion of the plug member, and having a width smaller than that of the slots. Each of the engaging legs has a thin guide portion receivable in a corresponding one of the slits, and an operating portion extending along an outer edge of the engaging leg and having a thickness larger than that of the thin guide portion. The operating portion is always disposed outside the socket member during insertion and detachment of the plug member relative to the socket member. The operating portion has a stopper portion formed as a step between the thin guide portion and the operating portion and engageable with one of opposite sides of the socket member to limit inward movement of the engaging leg.

Owing to their inwardly curved profile and the elongated openings formed therein, the engaging legs of the plug member are liable to bend or flex inwardly toward each other. In addition, a narrow portion extending between the elongated opening and the inner peripheral wall of each of the engaging legs can be readily flexed inwardly, so that the engaging legs of the plug member can be inserted in the socket member with a relatively small force. With the abutment portions of the locking portions provided, when the locking portions of the engaging legs and the retaining portions of the socket member are interlocked, the engaging legs are held in position against wobbling and are reliably held in the engaged position.

When the plug member is inserted in a socket member of the type having a pair of slots and a pair of slits continuously formed in the opposite side walls of the socket member, a pair of thick operating portions of on the respective engaging legs moves along the opposite side walls of the socket member, with a pair of thin guide portions of the respective engaging legs received in the slots. As the plug member is further inserted, the thin guide portions move from the slots into the slits, whereupon the locking portions of the engaging legs are lockingly engaged with the retaining portions in the socket member.

When the buckle is to be uncoupled, the engaging legs are resiliently bent inwardly toward each other by a relatively small force or pressure so that the locking portions can readily be disengaged from the retaining portions, allowing the plug member to be pulled out.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
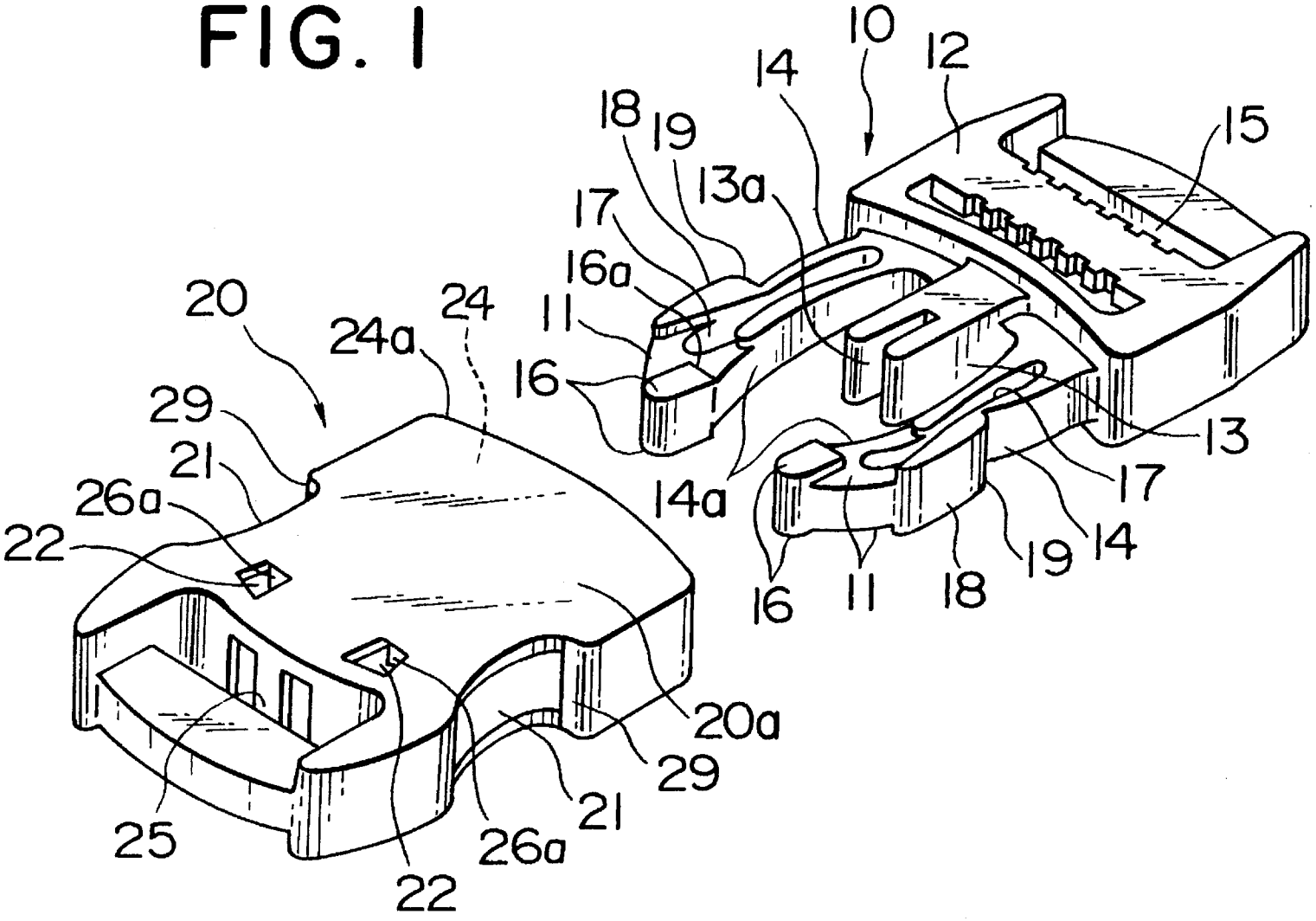
FIG. 1 is a perspective view of a buckle according to a first embodiment of the present invention shown in uncoupled condition.

Referring now to the drawings, wherein like reference characters designate like or corresponding parts throughout the several views, there is shown in FIGS. 1 to 4 a buckle according to a first embodiment of the present invention. The buckle is composed of a plug member 10 molded of synthetic resin and connectable to one of loose ends of a belt or the like (not shown), and a socket member 20 molded of synthetic resin and connectable to the other strap end (not shown). The plug member 10 and the socket member 20 are releasably engageable for fastening the strap end portions.

The plug member 10 has a base 12 and a pair of resiliently deflectable engaging legs 14, 14 extending in a common direction from an inner end of the base 12. The engaging legs 14, 14 are symmetrical with each other about a central axis of the plug member 10. Each of the engaging legs 14, 14 has a pair of first locking portions 16, 16 at a leading end thereof. The first locking portions 16, 16 each have a locking surface **16*a* facing toward the base 12 and beveled inwardly and forwardly at a slight angle relative to a line perpendicular to the direction of insertion of the plug member 10, and an outer ramp guide surface 16*b* beveled inwardly of the direction of insertion of the plug member 10**.

Figure 2:
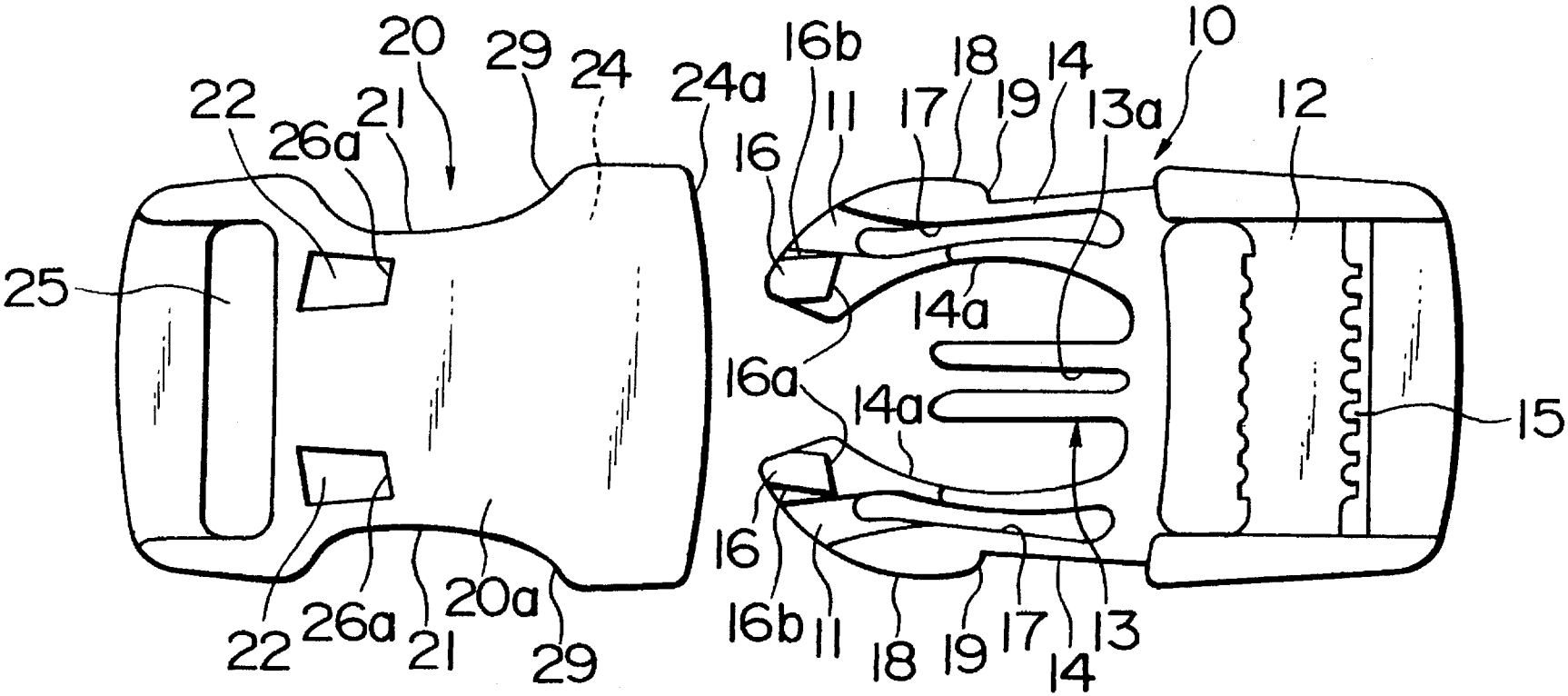
FIG. 2 is a plan view of the buckle with a plug member and a socket member shown in uncoupled condition.

The engaging legs 14, 14 are curved such that they are slightly expand or swelled outwardly with their leading end portions converging inwardly toward each other, as best shown in FIG. 2. The curved engaging legs 14, 14 each have an elongated opening 17 extending longitudinally between the proximal end and the leading end of the engaging leg 14 and extending through the engaging leg 14 in a direction perpendicular to a plane which is common to the engaging legs 14, 14. The elongated openings 17, 17 are curved arcuately and inwardly toward each other.

Each of the engaging legs 14, 14 has a bulged outer side flange forming an operating portion 18 which is stepped at the other or rear end to provide a second locking portion 19. The first locking portions 16 and the operating portion 18 of each engaging leg 14 define therebtween a pair of engaging grooves 11, 11 provided in upper and lower surfaces, respectively.

The base 12 of the plug member 10 has a belt attachment portion 15 through which a strap loose end extends. An elongated retaining bar 13 is formed integrally with the base 12 and interposed centrally between the pair of engaging legs 14, 14. The retaining bar 13 has an elongated guide slit **13*a*** therebetween.

The socket member 20 is generally in the form of a flat hollow box having an upper plate **20*a* and a lower plate 20*b* defining therebetween a guide chamber 24 for receptive engagement with the engaging arms 14, 14 of the plug member 10. The socket member 20 has an end opening 24*a* communicating with the guide chamber 24, through which the engaging legs 14, 14 of the plug member 10** are inserted.

The socket member 20 is interiorly provided with two pairs of first retaining portions 26. Each pair of first retaining portions 26, 26 extending in confronting relation from each of the upper and lower plates **20*a*, 20*b* in the guide chamber 24 for interlocking engagement with the corresponding first locking portions 16 of each engaging leg 14. The first retaining portions 26, 26 each have a retaining surface 26*a* complementary in contour to the shape of the locking surface 16*a* of the corresponding first locking portion 16. In order to form the retaining surfaces 26*a* by molding, a pair of apertures 22 is formed in the upper plate 20*a* of the socket member 20**.

Figure 3:
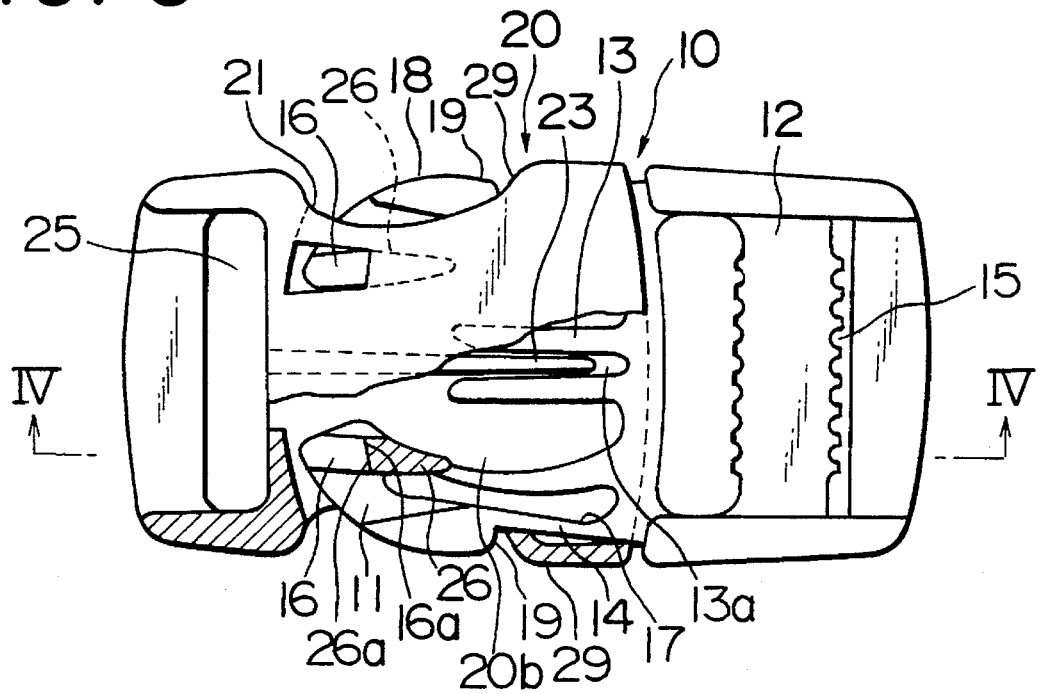
FIG. 3 is a plan view of the buckle with the plug member and the socket member shown in coupled condition.
Figure 4:
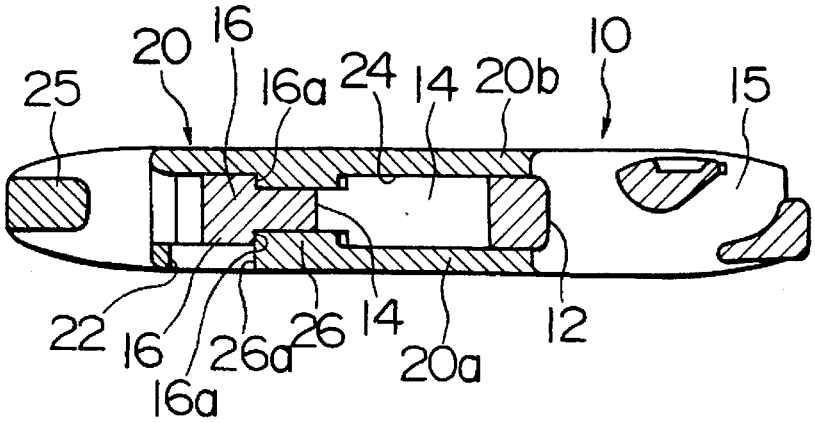
FIG. 4 is a cross-sectional view taken along line IV–IV of FIG. 3.

The socket member 20 has, in a pair of side walls, slots 21, 21 in confronting relation communicating with the guide chamber 24. The slots 21, 21 each are dimensioned to fit with the operating portion 18 of the plug member 10 and the operating portion 18 is exposed when the plug and socket members 10, 20 are coupled together as shown in FIG. 3.

The slots 21, 21 each terminate at a portion which serves as a second retaining portion 29 lockingly engageable with the second locking portion 19 of the corresponding engaging leg 14. The concave profile of the slots 21 provides a narrow part in the socket member 20.

The socket member 20 also includes a belt attachment portion 25 through which the other strap loose end extends. As shown in FIG. 3, the socket member 20 is interiorly provided with a guide wall 23 extending centrally between and interconnecting the upper and lower plates 20*a*, 20*b*. The guide wall 23 has a leading end portion for fitting engagement with the guide slit 13*a* in the retaining bar 13 of the plug member 10. The guide wall 23 and the retaining bar 13 cooperate to facilitate smooth insertion of the plug member 10 when the plug member 10 and the socket member 20 are coupled together. After the plug and socket members 10, 20 are coupled together, the guide wall 23 and the retaining bar 13 cooperate to keep the plug and socket members 10, 20 in a coupled position against wobbling.

The buckle of the foregoing construction operates as follows. To couple the buckle, the engaging legs 14, 14 of the plug member 10 are inserted through the end opening 24*a* into the guide chamber 24 in the socket member 20, in which instance the engaging legs 14, 14 are resiliently deflected inwardly toward each other as the operating portions 18, 18 slidingly contact with the inner surfaces of the second retaining portions 29, 29. As the plug member 10 is further inserted, the first locking portions 16, 16 on the leading ends of the engaging legs 14, 14 abut on the corresponding first retaining portions 26, 26 in the guide chamber 24, with the first retaining portions 26, 26 received in the engagement grooves 11, 11 in the engaging legs 14, 14. A continued insertion of the plug member 10 causes the outer ramp surfaces 16*b*, 16*b* of the first locking portions 16, 16 to slidingly engage with the inner surfaces of the first retaining portions 26, 26 with the result that the engaging legs 14, 14 are further deflected inwardly toward each other. As the plug member 10 is further inserted, the first locking portions 16, 16 move past the first retaining portions 26, 26 whereupon the engaging legs 14, 14 spring back into normal undeflected position. As a result, the first locking portions 16, 16 are lockingly engaged with the first retaining portions 26, 26, with the locking surfaces 16*a*, 16*a* held in abutment with the retaining surfaces 26*a*, 26*a*. Thus, the plug member 10 and the socket member 20 are coupled together. In this coupled condition of the buckle, the second locking portions 19, 19 of the respective engaging legs 14, 14 are firmly engaged with the second retaining portions 29, 29 of the socket member 20.

To disengage the plug member 10 and the socket member 20, the operating portions 18, 18 of the plug member 10 are depressed inwardly toward each other, whereupon the first locking portions 16, 16 are disengaged from the first retaining portions 26, 26, and the second locking portions 19, 19 from the second retaining portions 29, 29, allowing the plug member 10 to be pulled out. In this instance, since the socket member 20 is narrowed more toward an end of the guide chamber 24 remote from the end opening 24*a*, the pressure or force on the operating portions 18, 18 is mostly applied to the front end of the operating portions 18, 18 with the result that the uncoupling operation of the buckle can be easily achieved.

According to the buckle in the foregoing embodiment, the engaging legs 14, 14 of the plug member 10 are susceptible to elastic deformation due to the presence of the elongated openings 17, 17. In addition, since the respective inner peripheral walls 14*a*, 14*a* of the engaging legs 14, 14 are curved arcuately inwardly, when the engaging legs 14, 14 are subjected to a compressive force, the curved inner peripheral walls 14*a*, 14*a* resiliently flex to absorb the force. By virtue of the foregoing shape and configuration, the engaging legs 14, 14 can be smoothly inserted in and detached from the socket member 20 and are able to with-stand external force tending to damage the engaging legs 14, 14. When a pressing force is exerted on the operating portion 18, the beveled configuration of the locking surfaces 16*a* and the retaining surfaces 26*a* produces a component of force acting on the leading end of each of the engaging legs 14 in an obliquely outward direction opposite to the direction of the pressing force. Due to the resiliency of the respective arcuate inner peripheral walls 14*a*, 14*a* of the engaging legs 14, 14, the first locking portions 16, 16 are forced outwardly (in the direction of engagement relative to the corresponding first retaining portions 26), thereby enhancing the coupling strength between the first locking portions 16, 16 and the first retaining portions 26, 26. In addition, since the first locking portions 16, 16 are located on the leading ends of the respective engaging legs 14, 14, a resistance which is produced on insertion of the plug member 10, and a force which is required to disengage the plug member 10 and the socket member 20 are relatively small. On insertion of the plug member 10, the engaging legs 14, 14 are progressively deflected so that the inserting operation can be achieved smoothly with a relatively small force.

Figure 5:
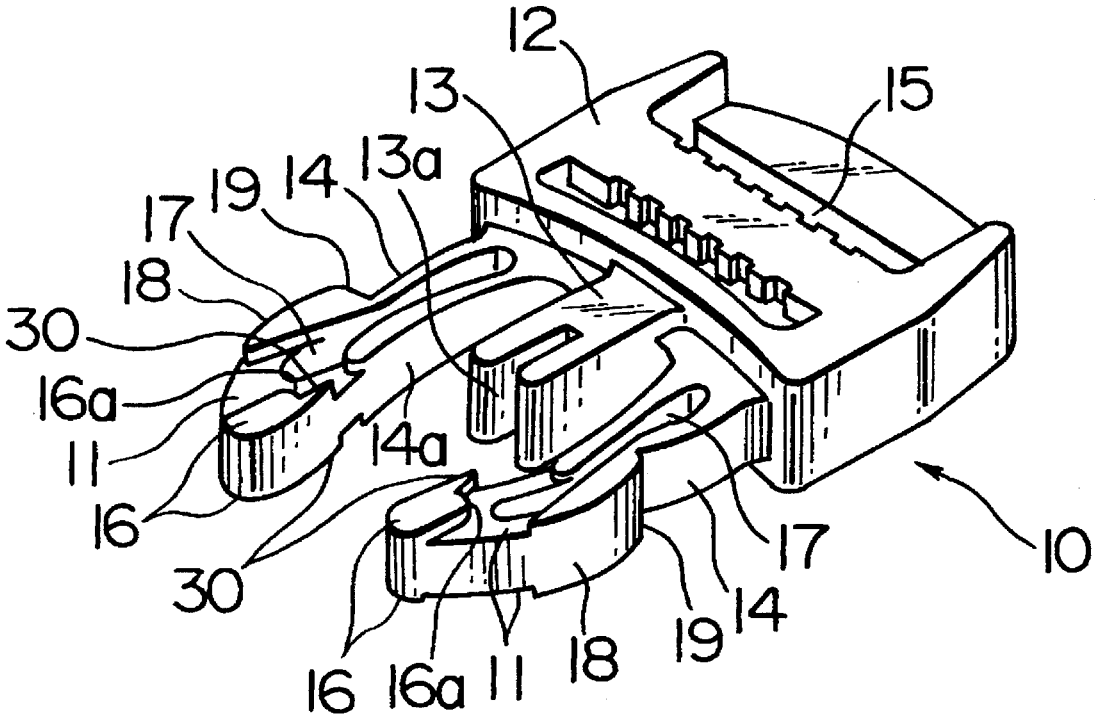
FIG. 5 is a perspective view of a plug member according to a second embodiment of the present invention.
Figure 6:
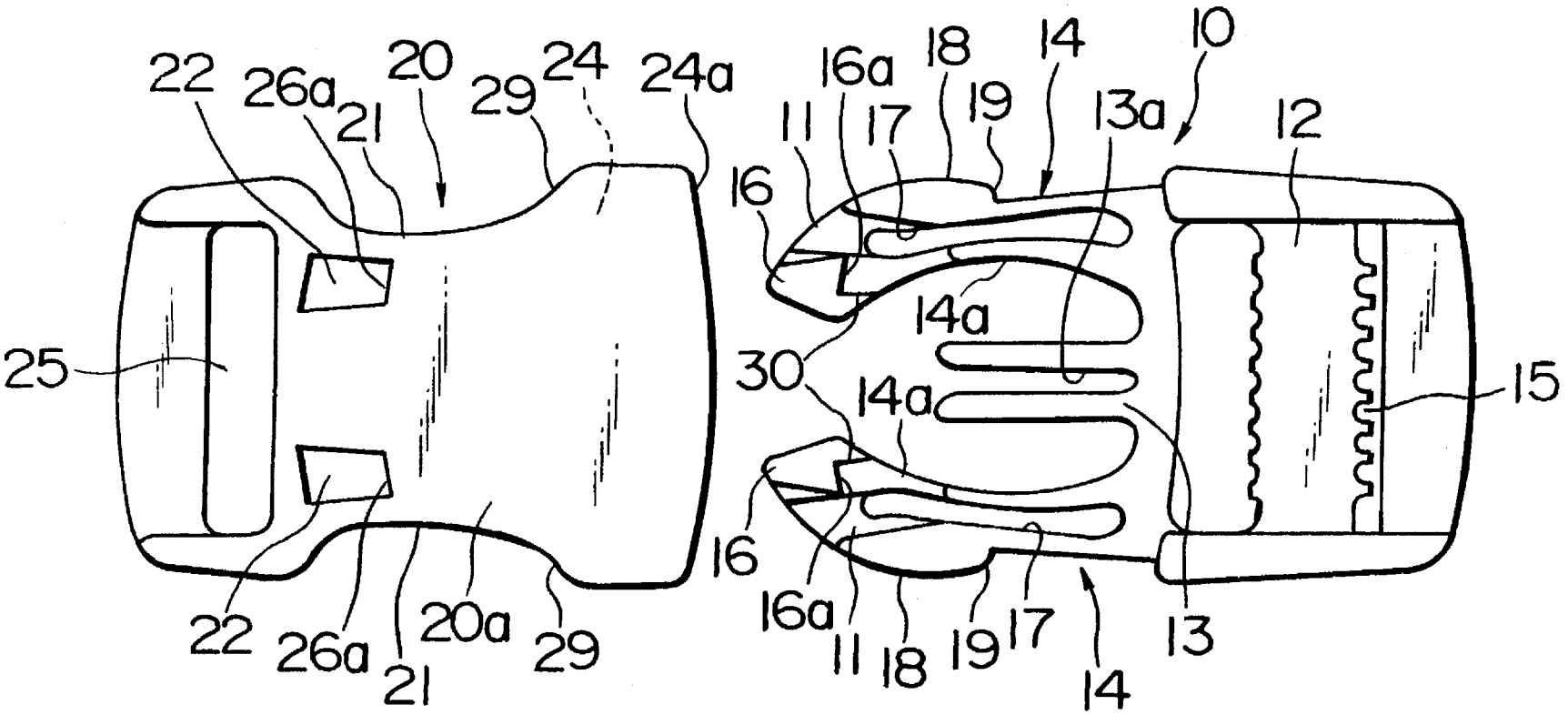
FIG. 6 is a plan view of a buckle having the plug member of FIG. 5 shown in uncoupled condition.
Figure 7:
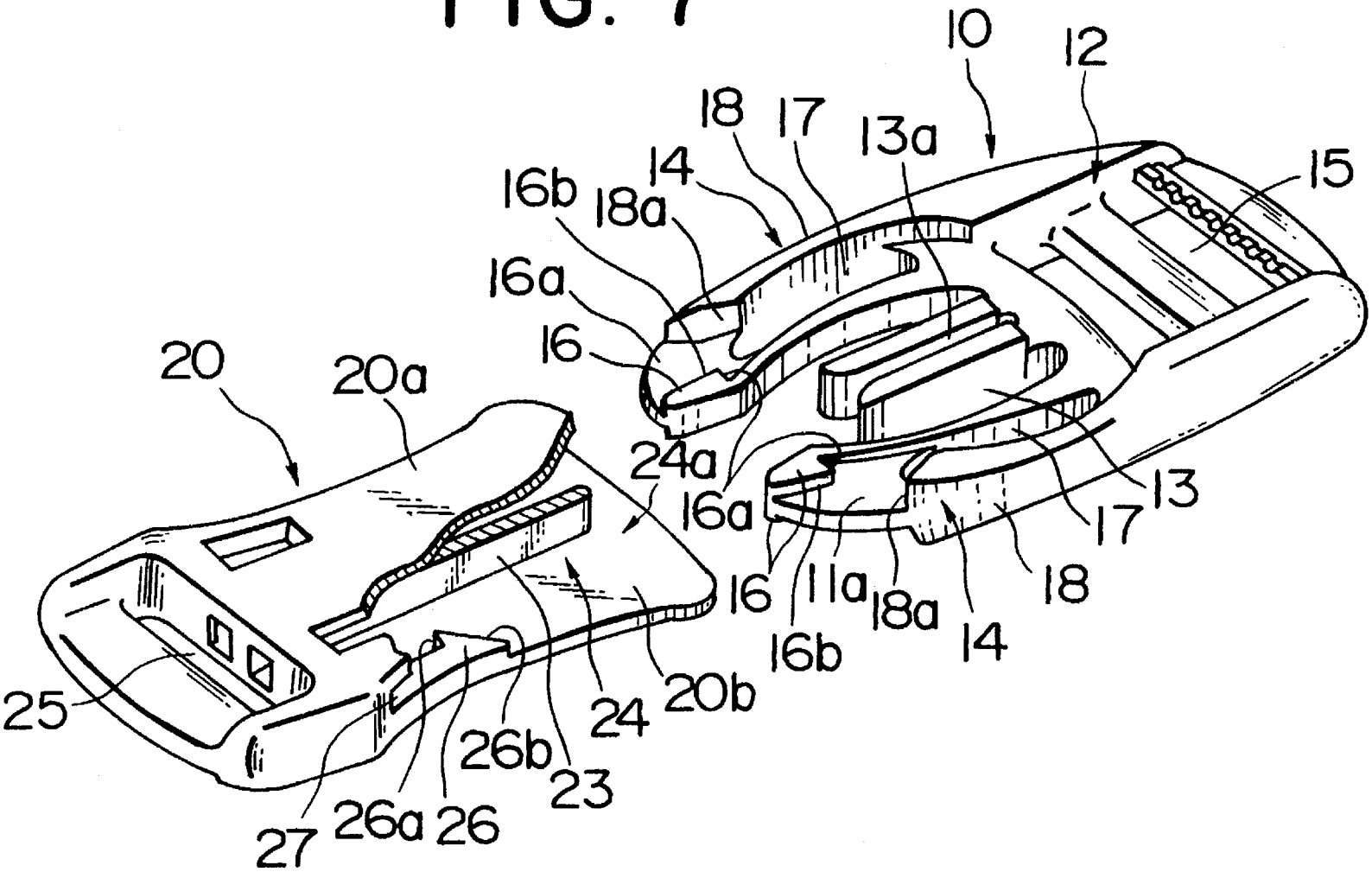
FIG. 7 is a perspective view, with parts cutaway for clarity, of a buckle according to a third embodiment of the present invention shown in uncoupled condition.
Figure 8:
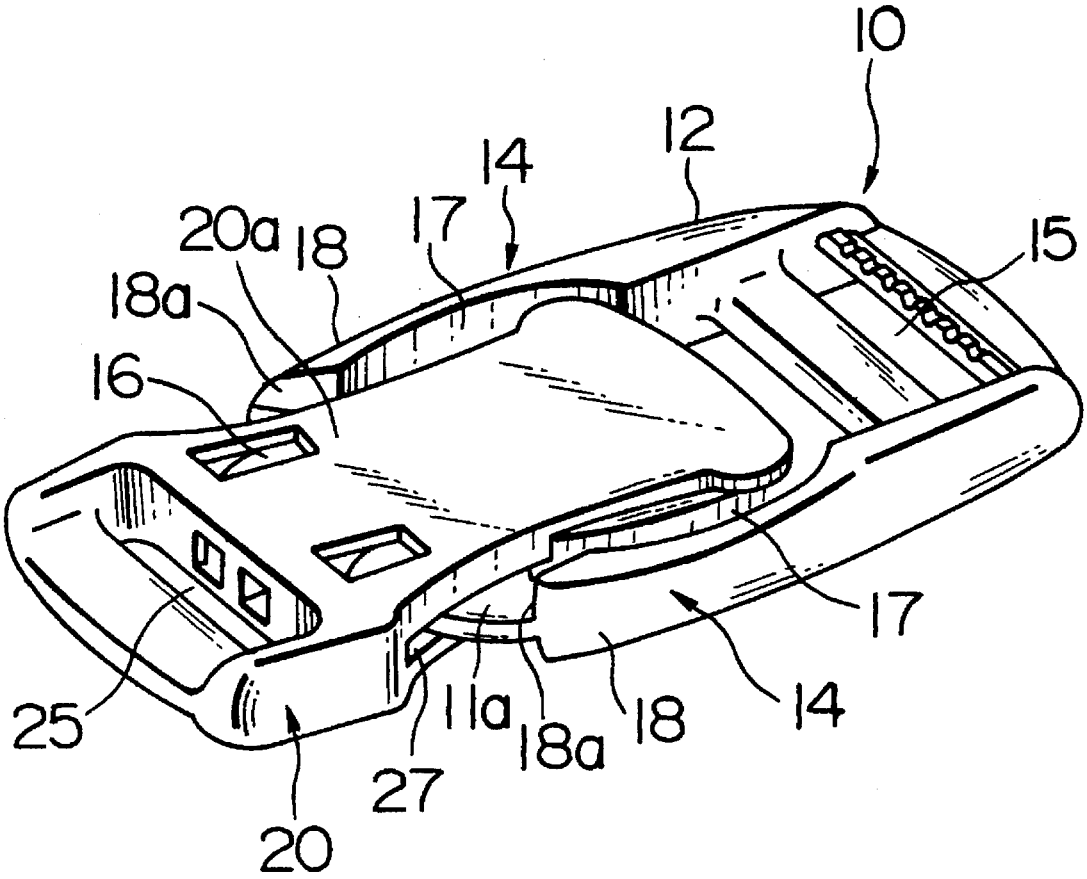
FIG. 8 is a perspsective view of the buckle of FIG. 7 with a plug member and a socket member shown in coupled condition.
Figure 9:
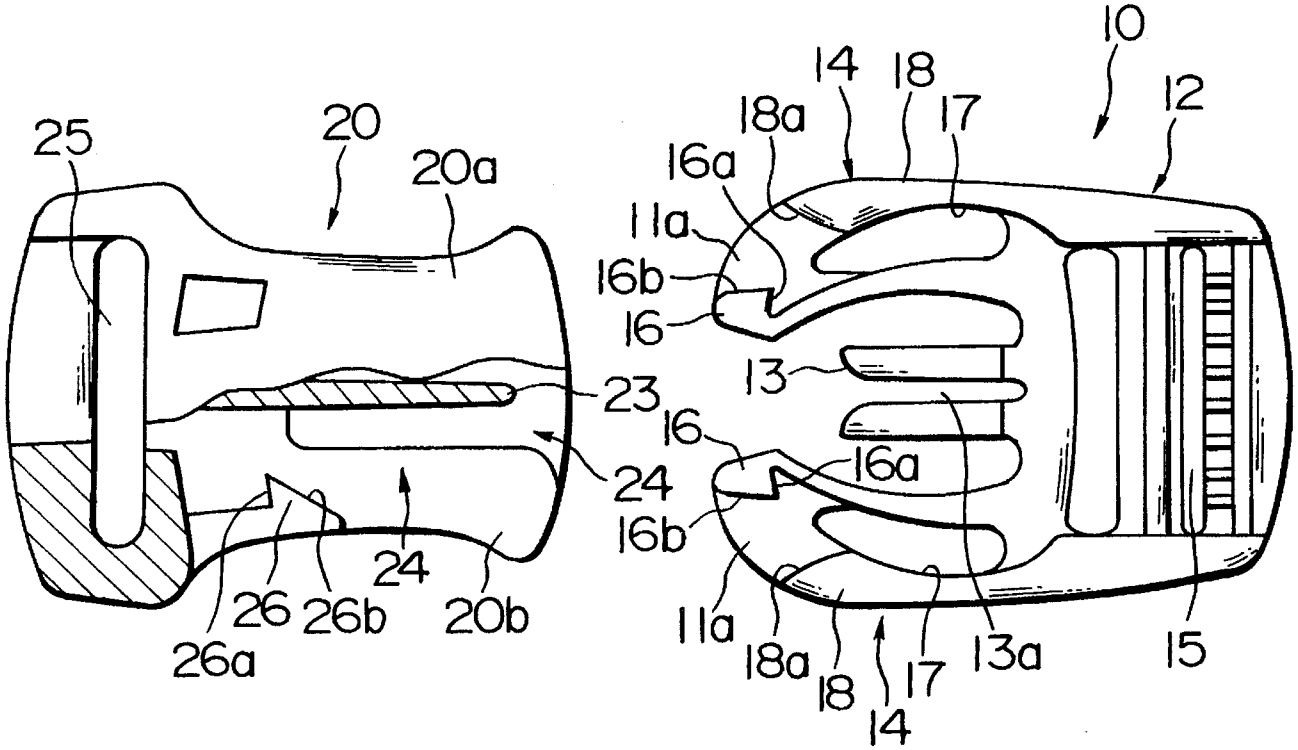
FIG. 9 is a plan view, with parts cutaway for clarity, of the buckle with the plug member and the socket member shown in uncoupled condition.
Figure 10:
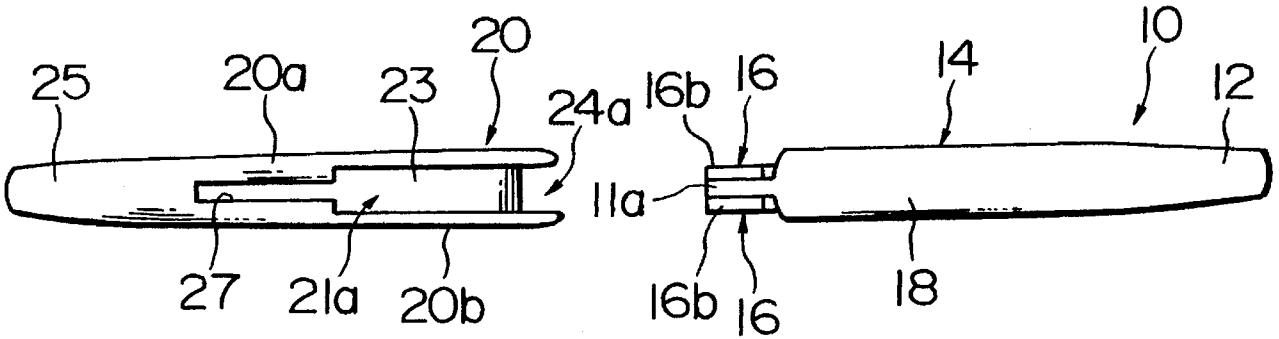
FIG. 10 is a side view of FIG. 9.
Figure 11:
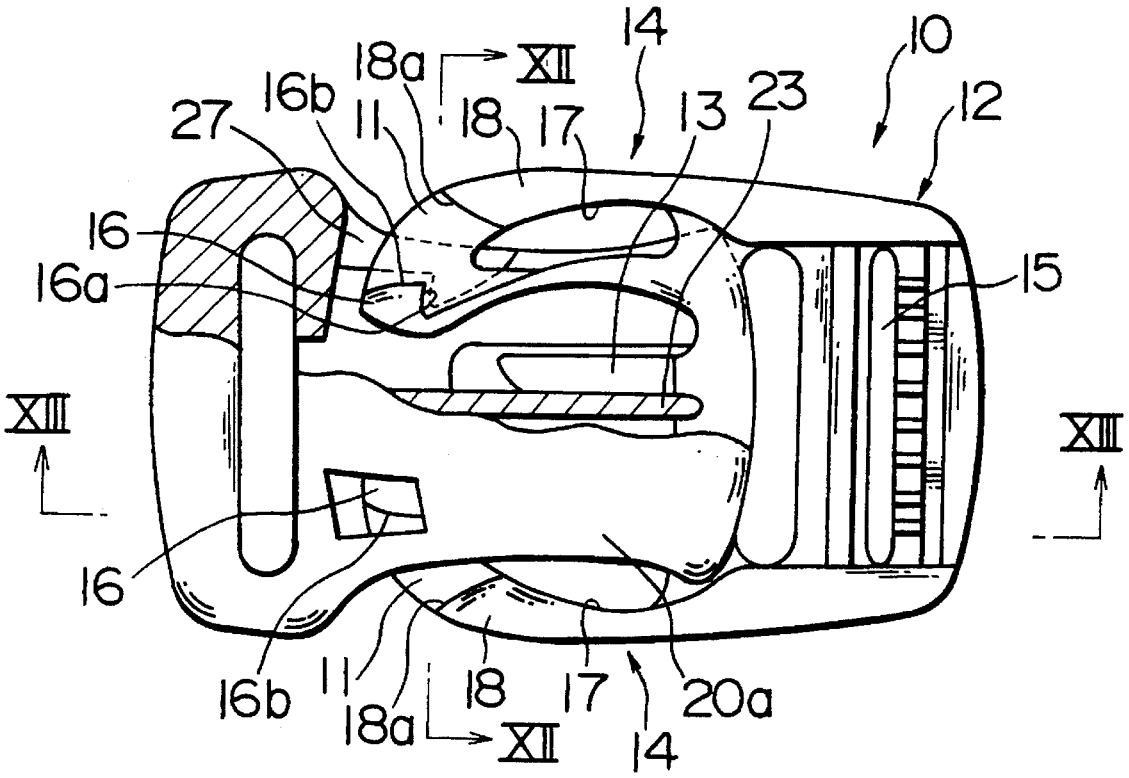
FIG. 11 is a plan view, similar to FIG. 7, showing the buckle shown in coupled condition.
Figure 12:
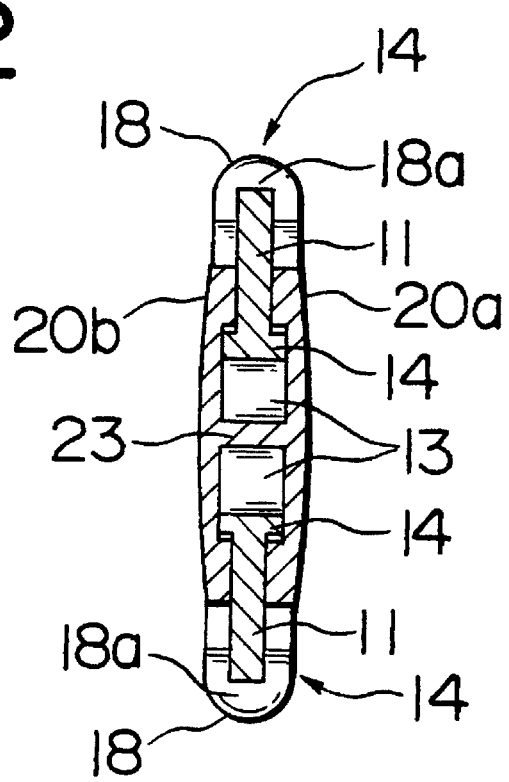
FIG. 12 is a transverse cross sectional view taken along line XII—XII of FIG. 11.
Figure 13:
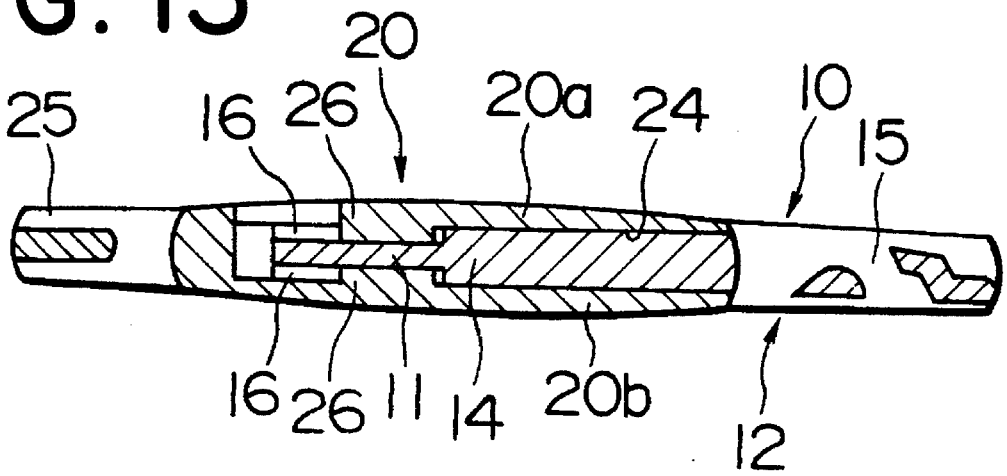
FIG. 13 is a longitudinal cross-sectional view taken along line XIII—XIII of FIG. 11.

FIGS. 5 and 6 show a second embodiment of the present invention. In this embodiment, these parts which are identical to those in the first embodiment shown in FIGS. 1–4 are designated by the same reference characters. The buckle in this embodiment differs from the buckle of the first embodiment in that the engaging legs 14, 14 each have a pair of abutment portions 30, 30 each formed on one of its upper and lower surfaces, respectively, and extending continuously from the locking surface 16*a* in a direction toward the base 12 for abutting engagement with an inner side surface of a corresponding one of the first retaining portions 26 when the first locking portion 16 is lockingly engaged with the corresponding first retaining portion 26.

When the first locking portions 16, 16 of the engaging legs 14, 14 are interlocked with the first retaining portions 26, 26 in the socket member 20 by the action of elastic return of the engaging legs 14, 14 to normal undeflected position, the abutment portions 30 are held in abutment with the inner side surfaces of the respective first retaining portions 26. Thus, the engaging legs 14, 14 are firmly locked in position against wobbling, so that the plug member 10 and the socket member 20 are firmly coupled together with improved degree of stability.

A third embodiment of the present invention will be described below with reference to FIGS. 7–13. In this embodiment, these parts which are identical to or corresponding to those in the first embodiment of FIGS. 1–4 are designated by the same reference characters, and, therefore, a further description is omitted.

The third embodiment differs from the first and second embodiments in that the operating portion 18 of each of the engaging legs 14, 14 extends continuously from the base 12 toward the leading end of the engaging leg 14 and terminates short of the leading end and has a uniform thickness throughout the length thereof. The leading end portion of the engaging leg 14 is recessed on its upper and lower surfaces to provide a thin guide portion 11*a* with a thickness smaller than other part of the engaging leg 14 is provided between the first locking portions 16, 16 and the operating portion 18. A front end of the operating portion 18, which is formed as a step between the operating portion 18 and the thin guide portion 11*a*, serves as a stopper portion 18*a* which is engageable with the side wall of the socket member 20 to limit inward movement of the engaging leg 14.

The socket member 20 comprises a pair of parallel spaced upper and lower plates 20*a* and 20*b*, and a guide wall extending centrally between and interconnecting the upper and lower plates 20*a*, 20*b* so as to define, between the upper and lower plates 20*a*, 20*b*, a guide chamber 24 for receiving therein the engagement legs 14, 14 of the plug member 10. The socket member 20 has an end opening 24*a* communicating with the guide chamber 24, through which opening the engaging legs 14, 14 of the plug member 10 are inserted. Opposite side edges of each of the upper and lower plates 20*a*, 20*b* are concaved at an intermediate portion so that the socket member 20 is narrowed in the middle and flared at opposite ends.

The socket member 20 is interiorly provided with two pairs of first retaining portions 26 extending in confronting relation from each of the upper and lower plates 20*a*, 20*b* for interlocking engagement with the first locking portions 16, 16 of the respective engaging legs 14, 14. The first retaining portions 26 each have a retaining surface 26*a* complementary in contour to the shape of the locking surface 16*a* of the corresponding first locking portion 16. The pair of first retaining portions 26, 26 of each of the upper and lower plates 20*a*, 20*b* have a pair of inner ramp surfaces 26*b* inclined inwardly from the end opening 24*a* in the direction of reception of the plug member 10.

The socket member 20 also has a pair of slots 21*a*, 21*a* defined in confronting relation on both sides, between opposite side edges of the upper and lower plates 20*a*, 20*b* and extending from the end opening 24*a*, and a pair of slits 27, 27 extending continuously from the respective inner ends of the slots 21*a*, 21*a* in the direction of insertion of the plug member 10. The slits 27, 27 are narrower than the slots 21*a*, 21*a* and have a width slightly larger than the thickness of the thin guide portions 11*a* of the engaging legs 14, 14. The socket member 20 further has a belt attachment portion 25 at an end remote from the end opening 24*a* for connection with a looped loose strap end.

The buckle in the third embodiment operates as follows. When the plug member 10 and the socket member 20 are to be coupled together, the engaging legs 14, 14 are inserted through the end opening 24*a* into the guide chamber 24 in the socket member 20, in which instance the guide wall 23 slidingly contacts with the inner peripheral surface of the leading end of one of the engaging legs 14, 14 to guide the advancing movement of the plug member 10 until the leading end of the guide wall 23 is received in the guide slit 13*a* in the retaining bar 13. Thereafter, the guide wall 23 is progressively received in the guide slit 13*a*, As the operating portions 18, 18 are slidingly inserted, the thin guide portions 11*a*, 11*a* of the respective engaging legs 14, 14 move from the slots 21*a*, 21*a* into the slits 27, 27.

As the forward movement of the plug member 10 further continues, the outer ramp guide surfaces 16*b* of the first locking portions 16 are brought into abutment with the inner ramp surfaces 26*b* of the first retaining portions 26 in the socket member 20, and then slide along the inner ramp surfaces 26*b* whereupon the engaging legs 14, 14 are resiliently deflected inwardly toward each other. As the plug member 10 is further inserted, the locking surfaces 16*a* of the first locking portions 16 contact with the retaining surfaces 26*a* of the first retaining portions 26, whereupon the engaging legs 14, 14 spring back outwardly away from one another and return to its normal undeflected position. Now, the first locking portions 16 are lockingly engaged with the first retaining portions 26, with the locking surfaces 16*a* held in abutment with the retaining surfaces 26*a*. Thus, the plug member 10 and the socket member 20 are coupled together. During the advancing movement of the engaging legs 14, 14, the operating portions 18, 18 are disposed outside the socket member 20 and move along the side edges of the socket member 20, with the thin guide portions 11*a*, 11*a* of the engaging legs 14, 14 movably received in the slits 27, 27. In response to elastic deflection of the engaging legs 14, 14, the operating portions 18, 18 move toward and away from each other.

To disengage the plug member 10 and the socket member 20, the operating portions 18 are depressed inwardly toward each other against the resiliency of the engaging legs 14, 14 until the stopper portions 18*a*, 18*a* abut on the side edges of the upper and lower plates 20*a*, 20*b*, by that time, the first locking portions 16 are disengaged from the first retaining portions 26, allowing the plug member 10 to be pulled out from the socket member 20. Since the operating portions 18, 18 are always located on the outside of the socket member 20 and they are movable along the side edges of the socket member 20, it is possible for the user to pull out the plug member 10 while continuously gripping the operating portions 18, 18.

According to the buckle of the third embodiment, the operating portions 18, 18 of the plug member 10 are always located on the outside of the socket member 20, so that insertion and detachment of the plug member 10 can be achieved with utmost ease. By continuously gripping the operating portions 18, 18 throughout the uncoupling operation of the buckle, it is possible to prevent the plug member 10 from jutting out from the socket member 20 by the action of the resiliency of the engaging legs 14, 14. In each of the engaging legs 14, 14 the first locking portions 16 and the operating portion 18 are formed integrally with each other via the thin guide portion 11. The engaging leg 14 of this construction insures reliable locking and releasing operation, has a sufficient strength, and can reduce the overall thickness of the buckle.

In addition, the engaging legs 14, 14 each having an elongated opening 17 has a high degree of resiliency and hence can be resiliently deflected with a relatively small force. When the engaging legs 14, 14 are subjected to a compressive force, the respective arcuate, concaved inner peripheral walls 14*a*, 14*a* of the engaging legs 14, 14 resiliently flex. Thus, the engaging legs 14, 14 can be smoothly inserted in and detached from the socket member 20 and are able to withstand external forces tending to break or damage the engaging legs 14, 14. When a pressing force is exerted on the operation portion 18, there is produced a component of force acting on the leading end of each engaging leg 14 in a the direction opposite to the direction of the pressing force with the result that the coupling strength created between the first locking portions 16 and the first retaining portions 26 is enhanced. More particularly, since the first locking portions 16 are located on the respective leading ends of the engaging legs 14, 14, a resistance produced during insertion of the plug member 10 and a force required to disengage the plug member 10 from the socket member 20 are relatively small. By virtue of sliding engagement between the inner ramp surfaces 26*b* of the first retaining portions 26 and the outer ramp guide surface 16*b* of the first locking portions 16, the engaging legs 14, 14 are deflected progressively. Accordingly, the engaging legs 14 can be inserted smoothly with a relatively small force.

The buckles shown in the embodiments described above should be construed as illustrative rather than restrictive. Namely, the shape and configuration of the engaging legs 14, operating portions 18, first locking portions 16, or first retaining portions 26 can be modified. For example, the thickness of the recessed portion between the guide grooves 11, 11 of the engaging leg 14 in the first and second embodiments and the thickness of the thin guide portion 11*a* of the engaging leg 14 in the third embodiment may be reduced to the minimum so as to reduce the overall thickness of the buckle. The position of the recessed portion and the position of the thin guide portion 11*a* can be changed if necessary. Similarly, the shape and configuration, number and position of the elongated opening 17 may be changed. For instance, the single elongated opening 17 formed in each of the engaging legs 14, 14 may be replaced with two or more elongated openings arranged longitudinally along the engaging leg 14.

It appears from the foregoing description that the engaging legs 14 curving inwardly toward each other and each having an elongated opening 17 can be resiliently deflected with a relatively small force, are able to provide a reliable locking engagement between the plug member 10 and the socket member 20 with high coupling strength, and are capable of withstanding external forces tending to break or damage the engaging legs 14. The plug member 10 having such engaging legs 14 simultaneously meet the requirements of the smooth and easy coupling and uncoupling operation of the buckle and the requirements of the large coupling strength between the plug member 10 and the socket member 20. The abutment portions 30 provided on the engaging legs 14 keeps the plug and socket members 10, 20 in a coupled condition against wobbling, thereby improving the stability of the coupling engagement. Due to the contour of the slots formed at the opposite sides of the socket member, when the operating portions 18 are depressed, compressive forces are applied to the leading ends of the respective resilient engaging legs 14. Thus, buckle uncoupling operation can be achieved with a relatively small force. The slots 21*a* may extend from an end opening 24*a* of the socket member 20 and each terminating in a slit 27 having a smaller width than the slot 21*a* for receiving therein a thin guide portion 11*a* of the engaging leg 14, in which instance the operating portions 18 are always disposed outside the socket member 20 during coupling and uncoupling operation of the buckle. With the slots 21*a* and slits 27 thus provided, the plug member 10 can be inserted in and detached from the socket member 20 with utmost ease, and the overall thickness of the buckle can be reduced.

Obviously, various minor changes and modifications of the present invention are possible in the light of the above teaching. It is therefore to be understood that within the scope of the appended claims the invention may be practiced otherwise than as specifically described.

What is claimed is:

1. A buckle comprising:

a plug member and a socket member which are releasably engageable with each other, said plug member including a base and a pair of resiliently deflectable engaging legs projecting from said base and receivable in said socket member, said engaging legs each having a locking portion at a leading end thereof, said socket member having a guide chamber for receptive engagement with said engaging legs, an end opening communicating with said guide chamber, and a pair of retaining portions disposed in said guide chamber for locking engagement with said locking portions of said engaging legs, respectively, said engaging legs being curved inwardly toward each other and each having an elongated opening extending longitudinally of said engaging leg and extending through the thickness of said engaging leg.

2. A buckle according to claim 1, wherein said socket member has an upper plate and a lower plate, and a central guide wall interconnecting said upper and lower plates along their central portions extending parallel to the direction of insertion of said plug member so as to define said guide chamber between said upper and lower plates.

3. A buckle according to claim 2, wherein said locking portion is disposed on each of an upper surface and a lower surface of each of said engaging legs, said pair of retaining portions being disposed on each of said upper plate and said lower plate, each of said locking portions having an abutment portion which is engageable with an inner side surface of corresponding one of said retaining portions when said locking portion and said retaining portion are lockingly engaged with each other.

4. A buckle according to claim 2, wherein said socket member has a pair of slots formed in confronting relation in opposite sides of said socket member and extending in the direction of insertion of said plug member from said end opening, and a pair of slit extending continuously from said slots, respectively, in the direction of insertion of said plug member, and having a width smaller than that of said slots, each of said engaging legs having a thin guide portion receivable in a corresponding one of said slits, and an operating portion extending along an outer edge of said engaging leg and having a thickness larger than that of said thin guide portion, said operating portion being always disposed outside said socket member during insertion and detachment of said plug member relative to said socket member.

5. A buckle according to claim 4, wherein said engaging leg has a stopper portion formed as a step between said thin guide portion and said operating portion and engageable with one of opposite sides of said socket member to limit inward movement of said engaging leg.

* * * * *